US010752422B2

(12) United States Patent
Gubler

(10) Patent No.: US 10,752,422 B2
(45) Date of Patent: Aug. 25, 2020

(54) SYSTEMS, METHODS AND DEVICES FOR SEALING STORAGE CONTAINERS

(71) Applicant: Jeffery Vance Gubler, Springville, UT (US)

(72) Inventor: Jeffery Vance Gubler, Springville, UT (US)

( * ) Notice: Subject to any disclaimer, the term of this patent is extended or adjusted under 35 U.S.C. 154(b) by 163 days.

(21) Appl. No.: 15/985,294

(22) Filed: May 21, 2018

(65) Prior Publication Data

US 2019/0135518 A1 May 9, 2019

Related U.S. Application Data

(60) Provisional application No. 62/509,036, filed on May 19, 2017.

(51) Int. Cl.
*B65D 53/02* (2006.01)
*B65D 81/20* (2006.01)
*B65D 51/16* (2006.01)

(52) U.S. Cl.
CPC ..... *B65D 81/2038* (2013.01); *B65D 51/1683* (2013.01); *B65D 53/02* (2013.01); *B65D 2543/00972* (2013.01)

(58) Field of Classification Search
CPC ..... B65D 81/2038; B65D 51/1683; B65D 53/02; B65D 2543/00972
USPC ..... 220/231
See application file for complete search history.

(56) References Cited

U.S. PATENT DOCUMENTS 4,249,583 A * 2/1981 Lundbladh ..... B65B 31/047 116/268
5,121,590 A * 6/1992 Scanlan ..... B65B 31/047 137/533.21
2006/0032852 A1* 2/2006 Cai ..... B65D 51/1683 220/287
2006/0231556 A1* 10/2006 Wei ..... B65B 31/047 220/203.18

* cited by examiner

*Primary Examiner* — King M Chu
(74) *Attorney, Agent, or Firm* — Terrence J. Edwards; TechLaw Ventures, PLLC

(57) ABSTRACT

Systems, methods, and devices for sealing a container are described and disclosed. A system includes a lid assembly configured to seal an opening of a container and a coupler assembly configured to be disposed within a recessed portion of the lid assembly. The lid assembly includes a recessed portion configured to facilitate coupling the lid assembly with an external vacuum source. The lid assembly includes a hole disposed within the recessed portion and a ball seal disposed in the hole, wherein the ball seal is configured to seal the hole in a closed position when a vacuum pressure is created within the container. The lid assembly includes a gasket cavity disposed within the lid assembly, wherein the gasket cavity is configured to align a gasket for creating a seal between the lid assembly and the container. The coupler assembly includes a coupler body, a coupler seal, and a vacuum port.

24 Claims, 11 Drawing Sheets

SYSTEMS, METHODS AND DEVICES FOR SEALING STORAGE CONTAINERS

CROSS-REFERENCE TO RELATED APPLICATIONS

This application claims the benefit of U.S. Provisional Application No. 62/509,036 entitled "SYSTEMS, METHODS, AND DEVICES FOR SEALING STORAGE CONTAINERS" filed May 19, 2017, and is hereby incorporated by reference herein in its entirety, including but not limited to those portions that specifically appear hereinafter, the incorporation by reference being made with the following exception: In the event that any portion of the above-referenced provisional application is inconsistent with this application, this application supersedes the above-referenced provisional application.

STATEMENT REGARDING FEDERALLY SPONSORED RESEARCH OR DEVELOPMENT

Not Applicable.

TECHNICAL FIELD

The present disclosure relates to storage containers and more particularly relates to a resealable lid for storage containers.

BACKGROUND

Food items spoil or become damaged when not properly stored. Spoilage caused by exposing certain foods to air represents significant consumer waste and can be avoided by storing the food items in a vacuum sealed receptacle. Certain perishable food items may be preserved for a longer duration when stored in a vacuum environment such that the exposure to air is eliminated or reduced. Food may be stored in specialized evacuable storage containers configured to create and maintain a vacuum environment within the container. Such evacuable containers can ensure food remains fresh for a longer duration when compared with standard storage containers.

DETAILED DESCRIPTION

Figure 1:
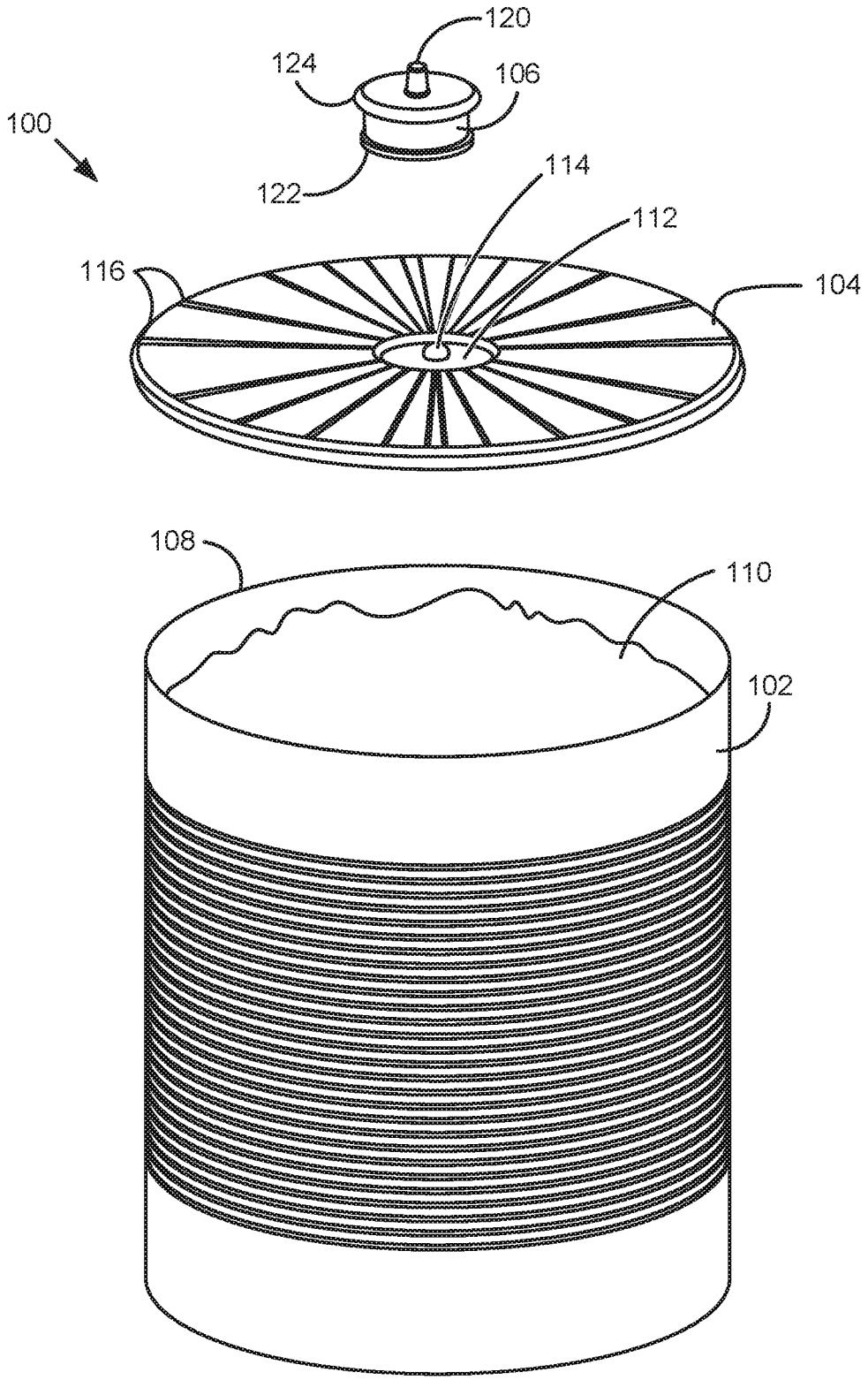
FIG. 1 illustrates a perspective view of components of a sealing system, according to one embodiment.

Food and other perishable items are often maintained in sealed containers, such as bottles, cans, bags, or other packaging. Sealed containers can help food to have a longer shelf life and avoid build-up or introduction of unwanted micro-organisms, chemicals, or the like. Furthermore, sealed containers help to maintain contents within the container without leaks.

In some cases, containers, such as metal cans, may be washed and reused for holding food or other items. However, sealing methods often require special equipment or tools. For example, metal cans often require special equipment for cutting or folding an upper edge and applying or crimping on new metal lids to create a sealed container. Because most consumers do not have access to such equipment, these metal cans often are thrown away, recycled, or used for storage or organization of non-perishable materials such as fasteners, or other hardware or craft supplies. Furthermore, creating a seal on larger containers such as #10 cans or other large containers, can be difficult without specialized equipment. (The designation "#10" is a description of a can that is typically used in the bulk foods industry.)

Applicant has developed systems, methods, and devices for sealing contents in a container. In one embodiment, a resealable lid and coupler may be used to vacuum seal contents within a container. The resealable lid may include a reinforced plastic lid with a recessed portion. A hole in the recessed portion may have a ball seal with a retaining mechanism extending through the hole. The coupler may be inserted into or around the recessed portion and a pump (such as a hand pump or electric pump) may be used to evacuate at least a portion of the air from the container via the hole in the recessed portion. The ball seal may allow air to leave the container during evacuation (e.g., using the vacuum) but may plug or seal the hole once a lower pressure is achieved inside the container (as opposed to the atmospheric or external pressure around the container). In one embodiment, an adapter is provided to connect tubing from the coupler to a hand pump or electric pump. In one embodiment, the resealable lid and coupler may be used to introduce and maintain a vacuum inside a container with a large opening. For example, a #10 can may be resealed using the lid and coupler after the original metal lid has been cut off the can.

In one embodiment, a sealing system may include a lid assembly, a coupler assembly, and vacuum hose assembly. The lid assembly may include a lid, a ball seal, and lid seal. The coupler assembly may include a coupler and U-seal. The vacuum hose assembly may include a length of hose and a fitting for coupling the hose to a desired hand or electric pump. In one embodiment, these parts, with one or more lid assemblies may be sold together as part of a package or kit. An accessory hand vacuum pump, procured as a complete unit, may also be provided separately or with the package or kit.

A detailed description of systems and methods consistent with embodiments of the present disclosure is provided below. While several embodiments are described, this disclosure is not limited to any one embodiment, but instead encompasses numerous alternatives, modifications, and equivalents. In addition, while numerous specific details are set forth in the following description to provide a thorough understanding of the embodiments disclosed herein, some embodiments may be practiced without some or all of these details. Moreover, for clarity, certain technical material that is known in the related art has not been described in detail to avoid unnecessarily obscuring the disclosure.

Turning to the figures, FIG. 1 is a perspective view of components of a sealing system 100, according to one embodiment, the sealing system includes a container 102, a lid assembly, and a coupler assembly. The container 102 may include any type of container, such as containers made of different materials or having different sized openings. In one embodiment, the container may include a large mouthed container, such as a metal can. Example metal cans may include a #10 can which has a width of 6 and 3/16 inches and a capacity of over 100 fluid ounces. The container 102 has an upper rim 108 which may have been previously cut after being packaged with foodstuff that has been consumed and removed. Foodstuff 110 to be sealed in the container is illustrated.

In one embodiment, the lid assembly includes a lid 104 (may alternatively be referred to as a lid assembly) constructed of food grade poly-carbonate (PC) plastic. The lid 104 may include only FDA compliant materials to allow for safes storage of foodstuff. In one embodiment, a stiff material, such as PC plastic is more desirable than softer, more flexible materials. For example, acrylonitrile butadiene styrene (ABS) is popular but may not be rigid enough to maintain a desired vacuum. The lid 104 includes ribs 116 to provide reinforcement to withstand vacuum pressures. Without sufficient stiffness or reinforcement, the lid 104 would implode, leading to loss of a seal or loss of contained goods. There is also a safety concern if the lid were to implode. The lid 104 may also have a dome shaped to further withstand vacuum pressures.

The lid 104 includes a recessed area 112 (or alternatively referred to as a recessed portion). The recessed area 112 may accommodate a lower end of the coupler assembly to facilitate the coupling of an external vacuum source with the lid 104 to evacuate air from the container 102. The recessed area 112 provides two surfaces, the bottom and sides of the recessed area 112, against which the coupler assembly can form an airtight seal during a vacuum sealing process.

The recessed area 112 also serves to position the ball seal 114 below the upper/outer surface of the lid, to prevent any interference of the ball seal 114 with another can that may be stacked on top. The lid 104 includes a hole in the center of the lid 104, in the recessed area 112 and below the ball seal 114. The ball seal is retained within the hole with a retaining mechanism (see at least FIG. 4 with the retaining mechanism 408).

The ball seal 114 may be formed or constructed of a food grade, FDA compliant, material. For example, ball seal 114 material may include a silicone plastic that is resilient and easy to clean. The ball seal 114 includes a spherical ball end and a retaining member that extends through a hole. For example, the retaining member may include a T-end that holds the ball sphere in the hole. The spherical ball end may selectively seal the hole and have a spherical shape that provides a consumer with an easy to grip surface. For example, the consumer may pull laterally or upward on the ball seal 114 to release a vacuum within a container. The T-end may connect to the spherical ball end via a stem. The stem may connect the spherical ball to the T-end and may have an outside diameter that tapers or steps-down to a narrower outside diameter nearer the T-end than at the spherical ball end. The tapered shape or step down may allow for max airflow when the ball seal 114 is lifted during evacuation (e.g., see FIGS. 5A-5D). The T-end has a larger outside diameter than the inside diameter of the hole in the lid 104. This serves as a retention feature to retain the ball seal in the lid when a vacuum is not present. In an embodiment, the stem comprises a sufficient length such that the spherical ball of the ball seal may be lifted during an evacuation process such that air may flow through the hole of the lid 104. In such an embodiment, the T-end of the ball seal retaining member may prevent the ball seal from escaping the hold of the lid assembly. In an embodiment, the stem is constructed of a flexible material such that the stem may be stretched during an evacuation process such that air may pass through the hole of the lid 104.

The lid 104 also includes a recess on an underside (see at least FIG. 4) to provide for a gasket that runs around the lid 104 near the circumference to provide a seal between the lid 104 and the upper rim 108 of the container 102. In one embodiment, an alignment rib assists in aligning the lid 104 to the container 102. For example, the rib may run along the underside of the lid, just inside the circumference of the lid (see e.g., FIG. 4). The lid seal may be formed or constructed of a food grade, FDA compliant, material. An example seal material may include a silicone plastic that is resilient and easy to clean and is sized and shaped to fit into the recess that run around the lid near the outside perimeter.

The coupler assembly includes a coupler body 106, a seal 122, and a vacuum port 120. The coupler body 106 may be formed or constructed of ABS plastic. The coupler body 106 has a lower diameter to connect to the seal 122 which may couple the coupler assembly against the top surface of the lid 104 in the recessed area 112 and around the side of the recessed area 112. An outer ring 124 is wider than the main body of the coupler body 106, to provide an easy and comfortable grip for a user. A vacuum port 120 facilitates connection with a mechanical vacuum via a vacuum hose. For example, a hose may fit over or inside the vacuum port 120.

In one embodiment, a vacuum hose may include a length of polyvinyl chloride (PVC) hose having an outside diameter of 6 millimeters and an inside diameter of 4 millimeters. In one embodiment, an additional fitting or adapter (not shown) may be used to adapt the hose to a desired port or connector on a vacuum. The fitting or adapter may be formed or constructed of ABS plastic. The fitting or adapter may include two interfacing port surfaces. The first port surface may be designed to fit into the accessory hose port, such as a hose port found on Food Saver® bag sealer vacuum devices, or other similar vacuum devices. The second port surface may be designed to fit into a corresponding hand vacuum pump offered as an accessory to the sealing system 100.

Figure 4:
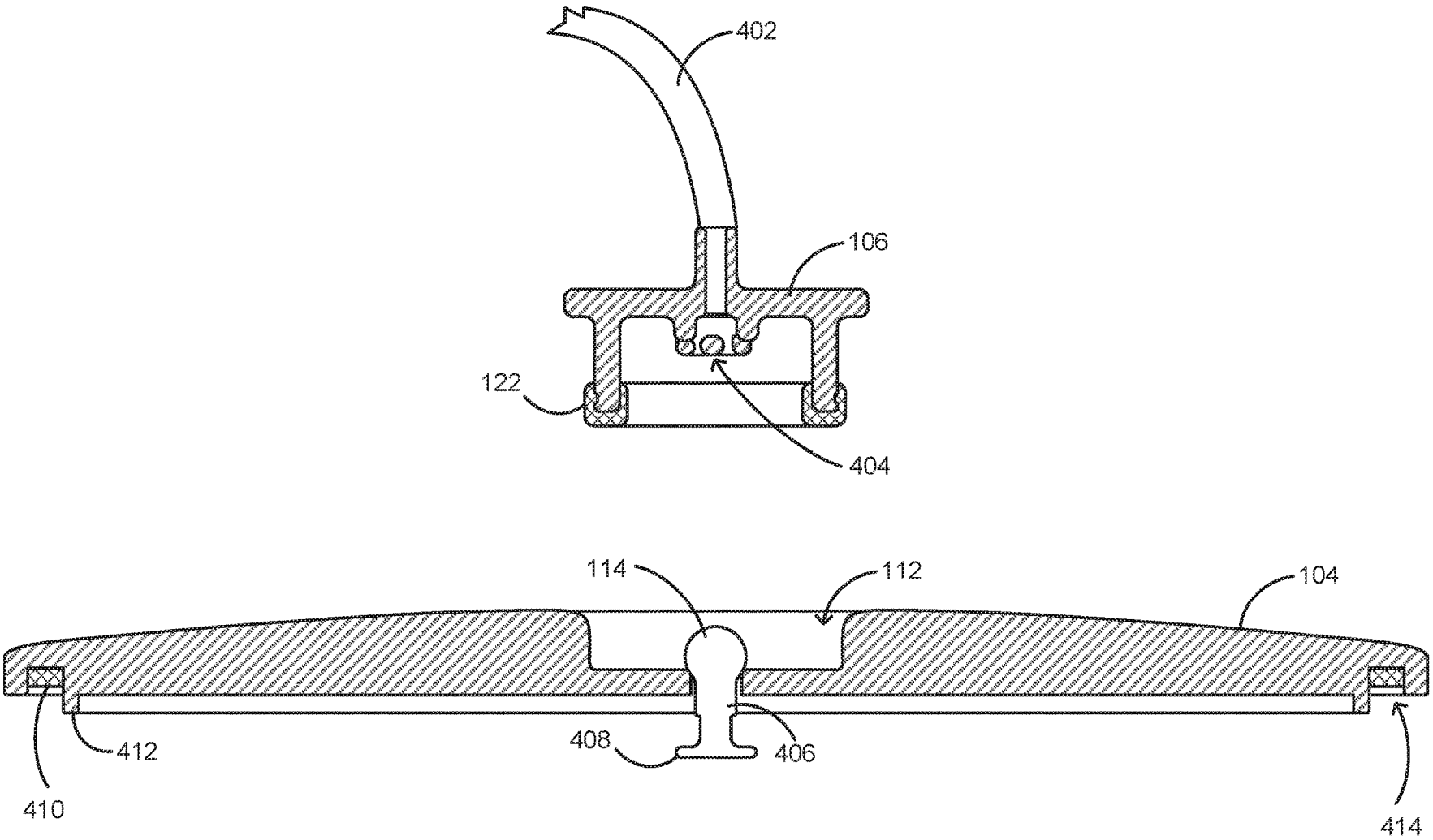
FIG. 4 is a cross sectional side view of a resealable lid assembly and coupler assembly, according to one embodiment.

The seal 122 may be a U-seal that fits around, below, and/or inside a lower end of the coupler body 106. The cross-section of a U-seal includes a U-shape, as can be seen in FIG. 4. Ridges or other features on the seal or coupler may help retain the seal 122 on the coupler body 106. Once again, the seal 122 may be formed or constructed of a food grade, FDA compliant, material, such as silicone plastic that is resilient and easy to clean. The seal has a shape to fit the coupler body 106 and the recessed area 112 of the lid 104. In one embodiment, the seal 122 forms a seal along the bottom, where the U-seal contacts the top surface in the recessed area 112 of the lid 104, and around the sides, where the U-seal contacts the sidewall of the recessed area 112 of the lid 104.

Figure 2:
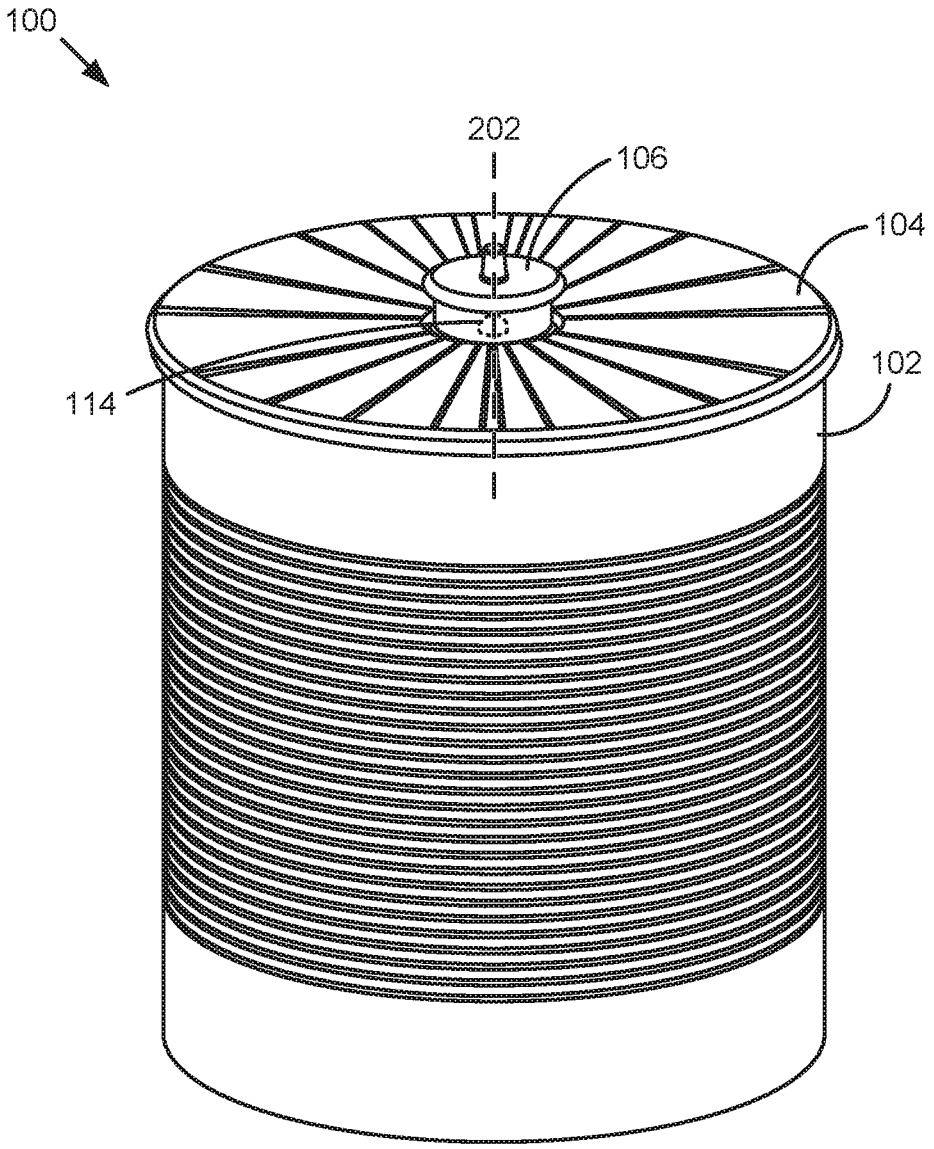
FIG. 2 illustrates a perspective view of a lid assembly positioned on a container and a coupler assembly positioned on a lid, according to one embodiment.

FIG. 2 is a perspective view illustrating the lid 104 positioned on the container 102 and the coupler body 106 positioned in the recessed area 112 of the lid 104. With the lid 104 and coupler assembly in place, a vacuum may be connected to the coupler assembly via a hose and/or a fitting or adapter to evacuate air from the container 102 and create a seal between the lid container 102 and lid, and between the lid and the ball seal 114. In one embodiment, the coupler body 106 may be transparent so that a user can see the position or movement of the ball seal 114 during the sealing process.

Figure 3:
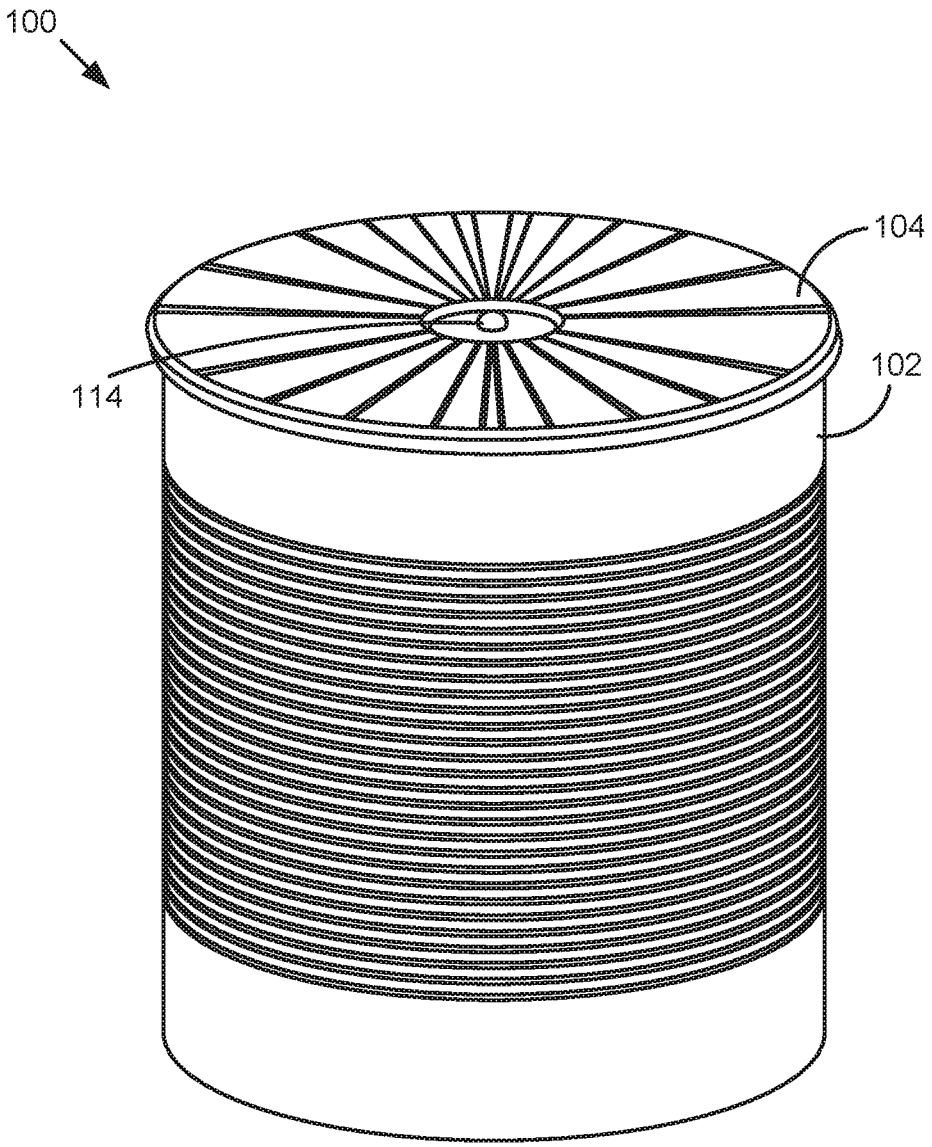
FIG. 3 illustrates a lid assembly positioned on a container, according to one embodiment.

FIG. 3 is a perspective view illustrating the lid 104 on the container 102 with the coupler assembly removed. In this state, the sealed container may be placed in storage. When the foodstuff in the container is to be used, a user may manipulate the ball seal 114 (e.g., by pulling it sideways) to allow air to enter the container 102 to equalize pressure between the container 102 and the environment and remove the seal created between the lid 104 and the container 102. The seal creation process and seal removal process will be discussed further below.

FIG. 4 is a cross sectional side view of a resealable lid assembly and coupler assembly taken along line 202 of FIG. 2, according to one embodiment. The lid assembly is shown with a ball seal 114 positioned above a hole in the lid 104 and a stem 406 extending through the hole and connecting the ball seal 114 to a retaining member 408 (e.g., a T-end of the ball seal 114). The length of the stem 406 allows the ball seal 114 to move vertically to selectively allow entry of air or create a seal. The stem 406 narrows near the retaining member 408 and widens near the ball seal 114 to improve air flow during evacuation of air and improve sealing after evacuation is complete. A rim seal 410 is shown near a rim of the lid 104 to match an upper rim of a container. The rim seal 410 is positioned in a recess or groove 414 near the rim of the lid. A ridge 412 is positioned in-side the rim seal 410 to position and/or retain the lid in position on an upper rim of a container.

The coupler assembly is shown with a coupled hose or tube 402. The coupler assembly may be positioned in the recessed area 112 and the seal 122 creates a seal between the coupler assembly and the lid 104. An inner surface 404 of the coupler body 106 includes channels or slits that allow air to pass even if/when the ball seal 114 contacts the inner surface 404. For example, when positioned in the recessed area 112, and during an evacuation process, the ball seal 114 contacts with the inner surface 404 of the coupler body 106. The distance between the inner surface 404 and the floor of the recessed portion 112 is designed to position the ball seal 114 against the inner surface to allow efficient airflow through the hole, around the stem 406, through the channels or slits into hose 402 during the vacuum creation process. The slits or channels in the inner surface 404 keep the ball seal 114 from sealing the passage into the hose 402.

Figure 5A:
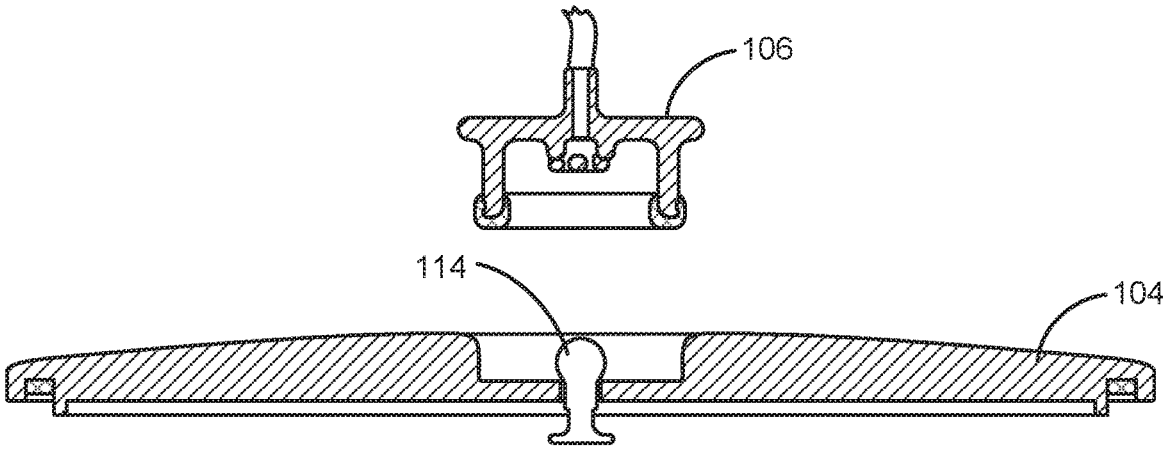
FIGS. 5A, 5B, 5C, and 5D illustrate a cross-sectional view of a resealable lid assembly and coupler assembly during a sealing process, according to one embodiment.
Figure 5B:
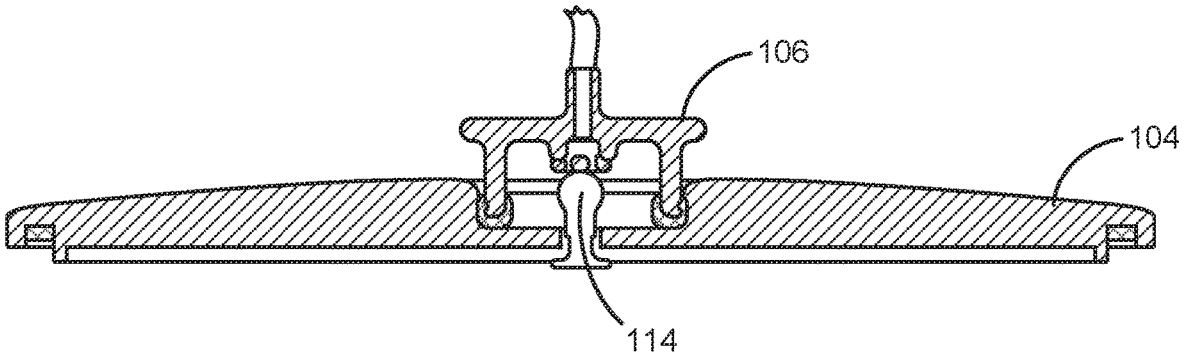

FIGS. 5A through 5D illustrate a cross-sectional view of the resealable lid and coupler during a sealing process. The container is not shown for simplicity in illustration. In FIG. 5A, the coupler assembly is shown uncoupled from the lid 104. The ball seal 114 may be resting on the hole and there may not yet be any vacuum in the container. In FIG. 5B, the coupler assembly is positioned in the recessed area of the lid 104 and a vacuum pumps air out. The outward moving air causes the ball seal 114 to rise and contact an inner surface of the coupler body 106. The ball seal 114 may rise when air is being evacuated (i.e., pumped out) using the vacuum or pump and fall when the air stops flowing. With an electric pump, the air may move smoothly so the ball seal 114 may rise until a sufficient vacuum is achieved in the container. With a hand pump, the ball seal 114 may rise and fall with each pumping motion. In one embodiment, when the ball seal no longer moves or rises in response to pumping, the user may know that a sufficient vacuum has been achieved. In one embodiment, the length of the stem of the ball seal 114 is long enough to allow the retaining end to stay below the lid 104 even when the ball seal 114 is in contact with the inner surface of the coupler body 106.

Figure 5C:
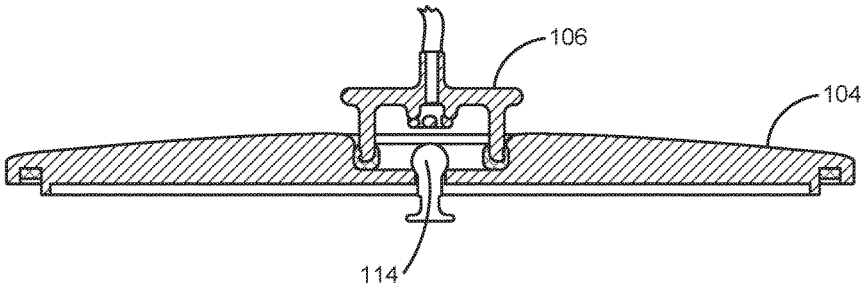
Figure 5D:
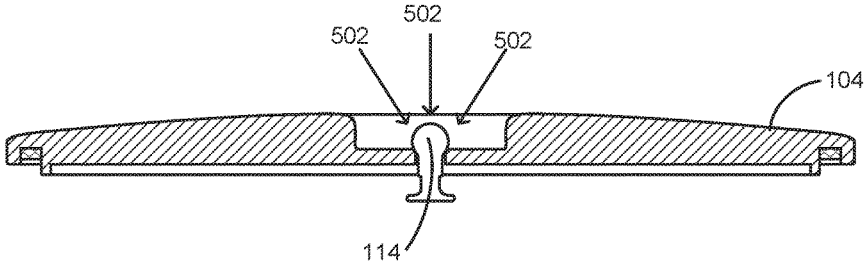

FIG. 5C shows the ball seal 114 resting on the hole in the lid 104. During pumping, the ball seal 114 may rest on the hole (e.g., and not rise or be in contact with the inner surface of the coupler body 106) when a sufficient vacuum has been created in the container to create and maintain a seal. In FIG. 5D, the coupler assembly has been removed. Because there is a vacuum in the container, the atmosphere around the container and lid 104 creates a force 502 to push the ball seal 114 against the hole and create a seal to keep internal contents preserved.

Figure 6:
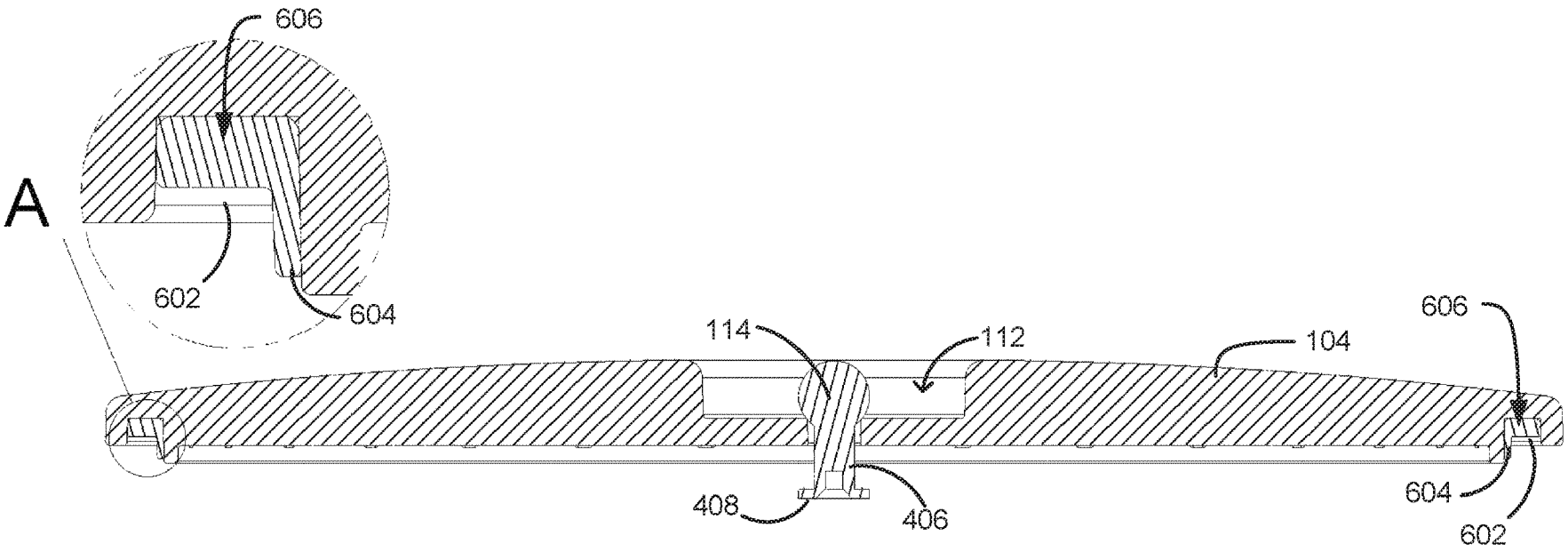
FIGS. 6 and 6A illustrate cross-sectional views of a resealable lid assembly, according to one embodiment.
Figure 6A:
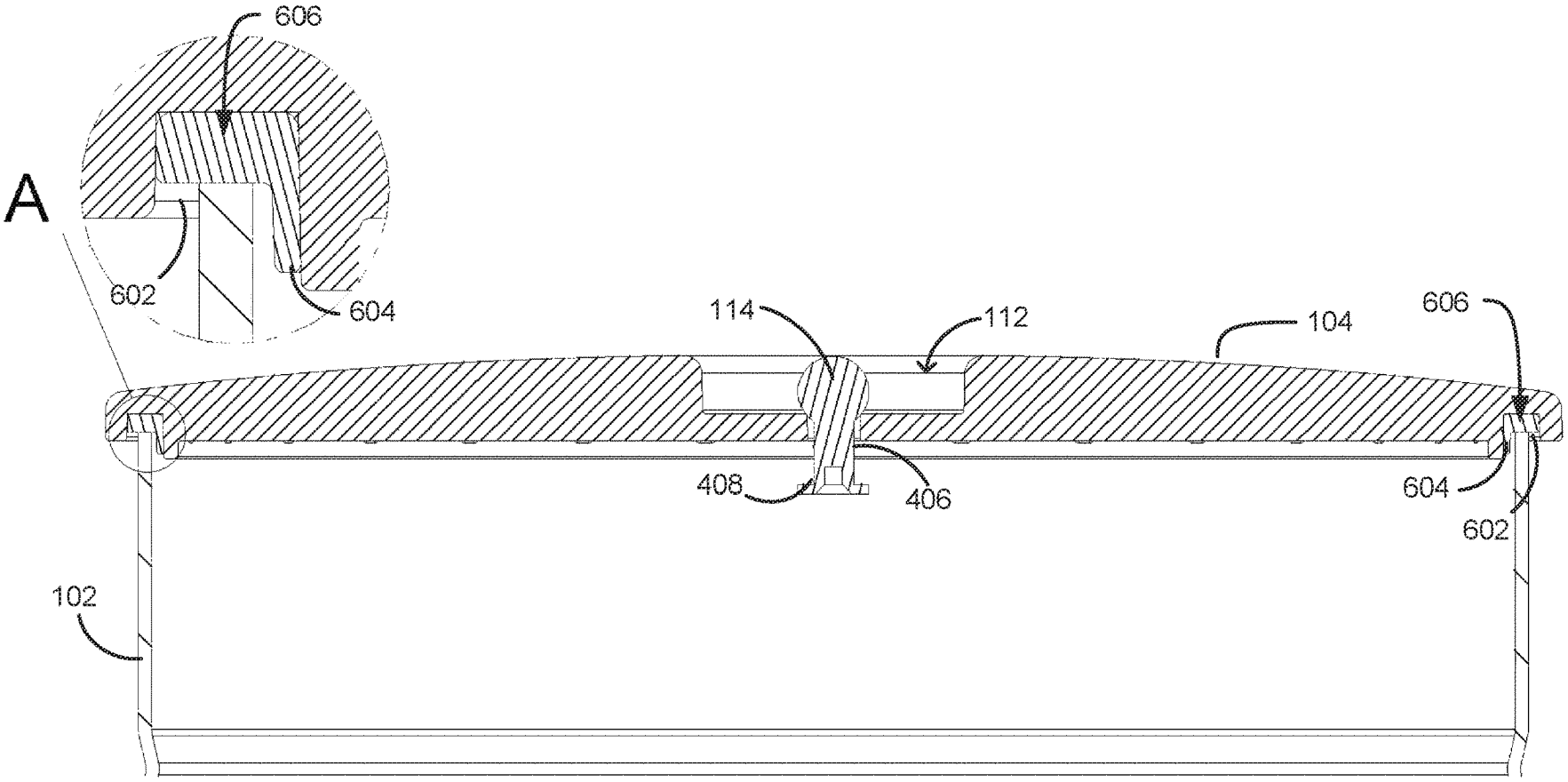

FIGS. 6 and 6A illustrate cross-sectional views of the resealable lid 104. The container 102 is illustrated in FIG. 6A and the container is not shown in FIG. 6 for simplicity in illustration. In FIGS. 6 and 6A, the ball seal 114 may be resting on the hole and there may not yet be any vacuum in the container. Alternatively, the container may be pressurized and the ball seal 114 may be sealing the hole to prevent any airflow out of the container. A rim seal 602 is shown near a rim of the lid 104 to match an upper rim of a container. The rim seal 602 is positioned in a recess 606 or groove (may alternatively be referred to as a gasket cavity) near the rim of the lid 104. A ridge 604 is positioned inside the rim seal to position and/or retain the lid in position on an upper rim of a container. The ridge 604 may be sized such that the lid 104 forms a tight seal with an upper ridge of a container such as a #10 canister. The ridge 604 may prevent the lid 104 from moving or adjusting on the upper ridge of the container and may promote a secure seal that is not prone to movement or adjustment. The rim seal 602 may be constructed of a flexible material suitable for forming an airtight seal. In an embodiment the rim seal 602 is constructed of a silicone material.

Figure 7:
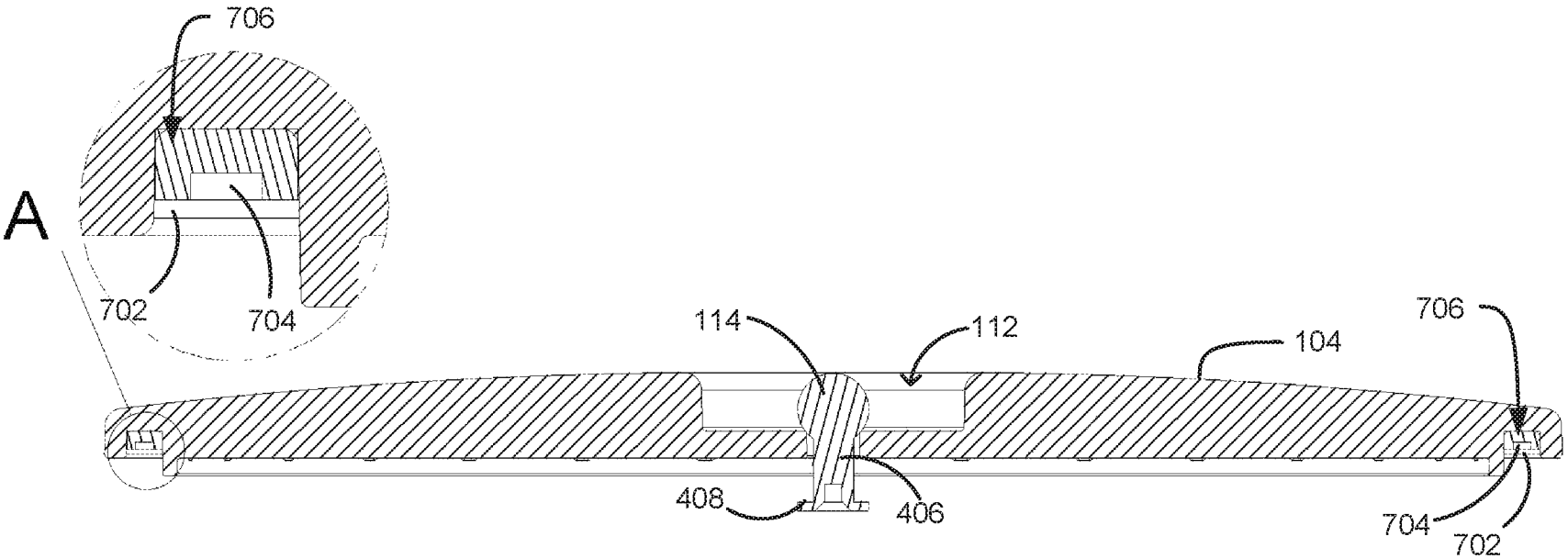
FIGS. 7 and 7A illustrate cross-sectional views of a resealable lid assembly, according to one embodiment.
Figure 7A:
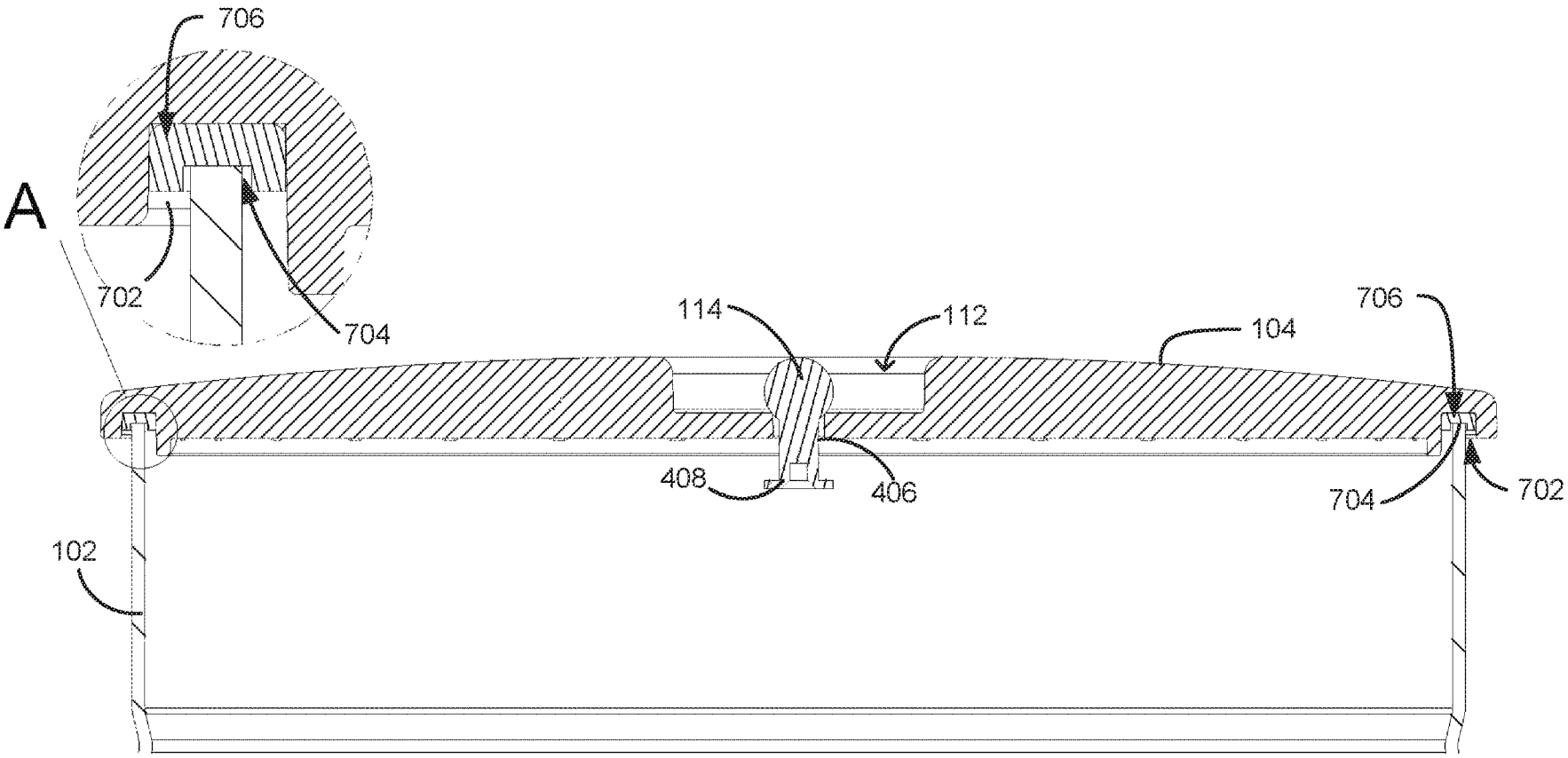

FIGS. 7 and 7A illustrate cross-sectional views of the resealable lid 104. The container 102 is shown in FIG. 7A and the container is not shown in FIG. 7 for simplicity in illustration. A rim seal 702 is shown near a rim of the lid 104 to match an upper rim of a container. The rim seal 702 is positioned in a recess 706 or groove (may alternatively be referred to as a gasket cavity) near the rim of the lid 104. A channel 704 is positioned inside the rim seal 702 to position and/or retain the lid in position on an upper rim of the container. The channel 704 may be sized such that the lid 104 forms a tight seal with an upper ridge of a container such as a #10 canister. The channel 704 may prevent the lid 104 from moving or adjusting on the upper ridge of the container and may promote a secure seal that is not prone to movement or adjustment. The rim seal 702 may be constructed of a flexible material suitable for forming an airtight seal. In an embodiment the rim seal 702 is constructed of a silicone material.

Figure 8:
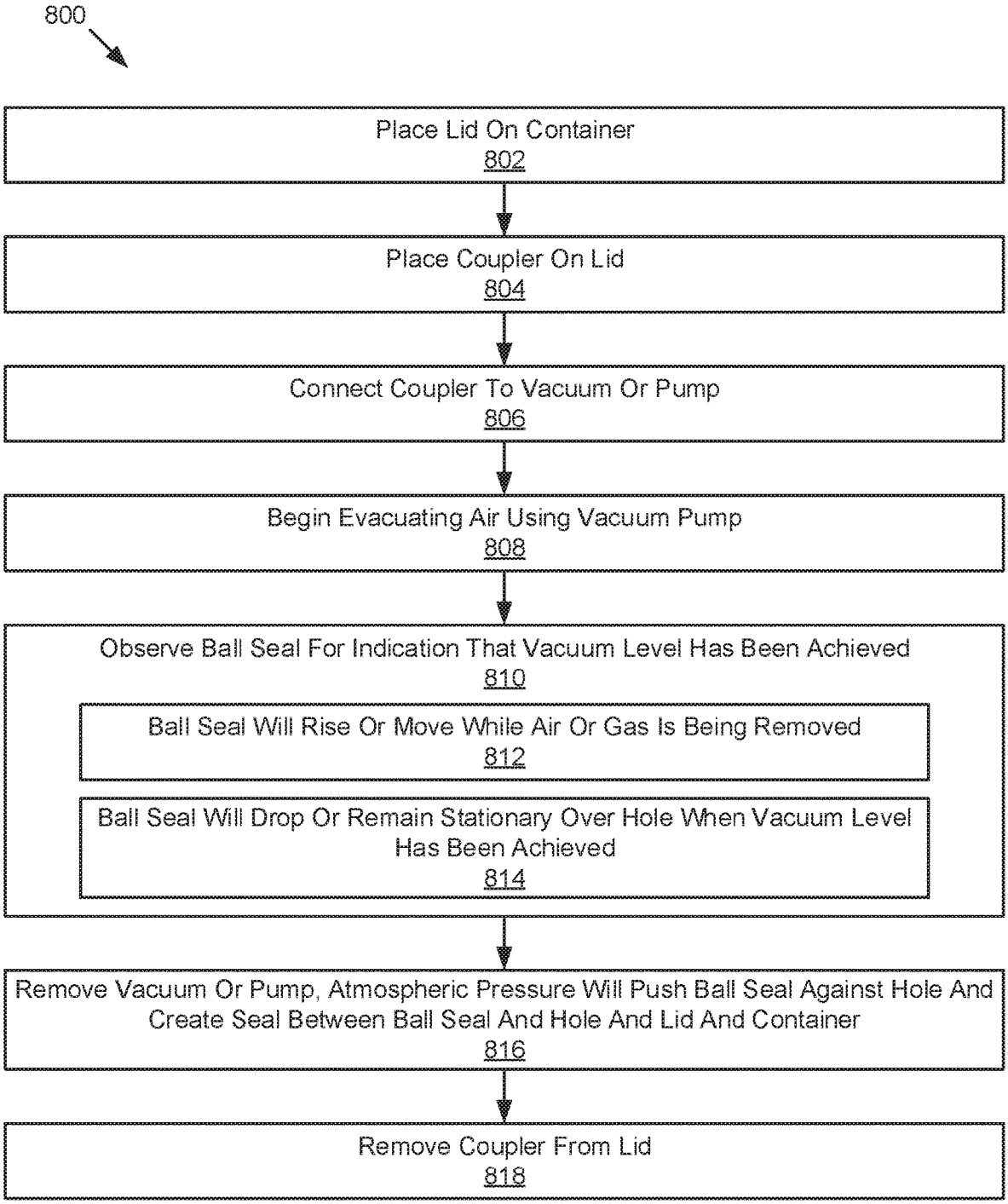
FIG. 8 is a schematic flow chart diagram illustrating an example method for sealing a container, according to one embodiment.

FIG. 8 is a schematic flow chart diagram illustrating an example method 700 for sealing a container. The method 800 may be performed using the systems, devices, or assemblies disclosed herein. The method 800 begins and a lid 104 is placed 802 on a container 102. A coupler assembly is placed 804 on the lid 104, such as within a recessed area 112. The coupler assembly is connected 806 to a vacuum or pump. The vacuum or pump may include an electric, hand, or other vacuum or pump. The user may start or actuate the vacuum or pump to begin evacuating 808 air. The user observes 810 the ball seal for an indication that a vacuum level has been achieved. For example, the user may be able to observe the ball seal through a transparent lid 104 or coupler body 106. While air or gas is being removed or evacuated, the ball seal will rise or move 812. The ball seal may drop or remain stationary 814 over the hole when the vacuum level has been achieved. When a hand pump is moved, the air flow may not be smooth, so the ball seal may rise and fall with the pumping movement. A user may determine that a maximum vacuum level has been reached when the ball seal no longer moves. When an electric pump is used, the air flow may be smooth so the ball seal may rise until a desired vacuum level has been reached and then the ball seal may drop. A user may be able to watch until the ball seal drops to ensure that a desired vacuum level has been achieved. Although it may be difficult to achieve a perfect vacuum, the size of the stem, ball seal, and hole in the lid may be configured to allow for the ball seal to drop or remain stationary when a desired vacuum level is achieved. The ball seal may be formed of a bright or dark color to make it easy to observe through a lid or coupler body.

The vacuum or pump may be turned off or removed 816. Upon removal, atmospheric pressure may cause the ball seal to be forced into/against the hole to create a seal. The coupler assembly is removed 818 from the lid and the lid remains sealed to the container. The container and contents may then be stored/stacked.

EXAMPLES

The following examples pertain to further embodiments:

Example 1 is a system for sealing a container may include a container, a lid assembly, and a coupler assembly. The lid assembly may include a resealable lid for selectively sealing the opening an opening of the container. The lid assembly may include a lid with reinforcement ridges or structures and a recess portion. A hole positioned in the recess portion may allow air to move through the lid. A ball seal is positioned in the hole such that a vacuum in the container pulls the ball seal into the hole to seal the hole in a closed position. The coupler assembly include a coupler body and a seal member positioned on the coupler body to create a seal between the coupler body and the lid (e.g., the recess portion of the lid). The coupler assembly includes a hole or port for connecting to a vacuum or pump.

Example 2 is a system as in Example 1, wherein when air is being removed using the coupler, the ball seal is allowed to move in an upward direction to allow air to be evacuated from the container body. When the pump or vacuum or coupler is removed, atmospheric or environment pressure forces the ball seal into/against the hole. The coupler body includes an inner surface with channels/slits around the hole to the pump to allow air to pass by the ball seal when the ball seal is raised and in contact with the inner surface of the coupler. The ball seal may be connected to a retaining member (e.g., T-end) to retain the ball seal in the lid. The inner surface of the coupler body limits the upward travel of the ball seal so as to maintain an opening in the lid sufficient to facilitate the evacuation of air. A stem connecting the ball seal to the retaining member narrows as it moves away from the ball seal and toward the retaining member. For example, the stem may be stepped up or down in diameter to provide greater clearance between the stem and the hole in the lid, thereby improving air flow during evacuation. The lid and/or coupler body may be clear or at least semi-transparent so that the ball seal can be seen (when it drops or fails to move during a pumping motion, the user knows there is a sufficient vacuum).

Example 3 is a system for sealing a container. The system includes a lid assembly configured to seal and opening of a container. The lid assembly includes: a recessed portion configured to facilitate coupling the lid assembly with an external vacuum source; a hole disposed within the recessed portion of the lid assembly; a ball seal disposed in the hole, the ball seal configured to seal the hole in a closed position when a vacuum pressure is created within the container; and a gasket cavity disposed within the lid assembly, the gasket cavity configured to align a gasket for creating a seal between the lid assembly and the container. The system includes a coupler assembly comprising a vacuum port, the coupler assembly configured to be disposed within the recessed portion of the lid assembly.

Example 4 is a system as in Example 3, wherein the lid assembly further comprises one or more reinforcement ribs extending radially from the recessed portion to an outer edge of the lid assembly.

Example 5 is a system as in any of Examples 3-4, wherein the ball seal permits airflow out of the container through the hole of the lid assembly during an evacuation process and the ball seal seals the hole in a closed position when a lower pressure is achieved inside the container relative to atmospheric or external pressure.

Example 6 is a system as in any of Examples 3-5, wherein the ball seal comprises: a spherical ball comprising a circumference greater than an inside boundary of the hole of the lid assembly; and a ball seal retaining member. The ball seal is such that the ball seal retaining member extends through the hole and the spherical ball is located on an exterior side of the lid assembly relative to the container.

Example 7 is a system as in any of Examples 3-6, wherein the ball seal retaining member comprises a T-end, and wherein the T-end comprises an outside perimeter greater than the interior boundary of the hole such that the ball seal is retained within the hole of the lid assembly.

Example 8 is a system as in any of Examples 3-7, wherein the ball seal comprises a stem connecting the spherical ball to the T-end of the ball seal retaining member, and wherein the stem comprises a sufficient length to permit the spherical ball to be lifted during an evacuation process such that air may pass through the hole of the lid assembly.

Example 9 is a system as in any of Examples 3-8, wherein the ball seal provides a seal for maintaining a vacuum pressure within the container and wherein the ball seal further provides a means for releasing the vacuum pressure within the container and reintroducing air into the container.

Example 10 is a system as in any of Examples 3-9, wherein the hole of the lid assembly provides the only means for extracting or introducing air into the container when the lid assembly forms a seal with the container.

Example 11 is a system as in any of Examples 3-10, wherein the ball seal further comprises a stem, and wherein the stem comprises: a stem length sufficient for the ball seal to move in a vertical direction approximately normal to the lid apparatus when the ball seal is disposed within the hole; an upper portion located near the spherical ball of the ball seal; and a lower portion located near the T-end of the ball seal retaining member. The stem of the ball seal is such that the lower portion comprises a shorter diameter than the upper portion.

Example 12 is a system as in any of Examples 3-11, wherein the coupler assembly further comprises: a coupler body; and a coupler seal disposed about an exterior of the coupler body; wherein the coupler body comprises an outsider perimeter smaller than an interior boundary of the recessed portion of the lid assembly.

Example 13 is a system as in any of Examples 3-12, wherein the coupler seal creates an airtight seal between the coupler assembly and the recessed portion of the lid assembly such that a vacuum pressure may be created within the container when the lid assembly forms a seal with the container.

Example 14 is a system as in any of Examples 3-13, wherein the ball seal contacts an inner surface of the coupler body during an evacuation process in which a vacuum pressure is created within the container.

Example 15 is a system as in any of Examples 3-14, wherein the coupler body is sized such that a distance extending from the inner surface of the coupler body to an exterior surface of the recessed portion of the lid assembly permits airflow through the hole of the lid assembly during the evacuation process.

Example 16 is a system as in any of Examples 3-15, wherein the coupler assembly further comprises one or more channels disposed within the inner surface of the coupler body, wherein the one or more channels are configured to permit airflow during the evacuation process.

Example 17 is a system as in any of Examples 3-16, wherein the vacuum port of the coupler assembly facilitates connection with a mechanical vacuum apparatus via a vacuum hose such that the vacuum hose may fit over or inside the vacuum port.

Example 18 is a system as in any of Examples 3-17, wherein the coupler assembly further comprises a coupler body and wherein the coupler body is transparent such that a user may see the ball seal when the coupler is disposed within the recessed portion of the lid assembly.

Example 19 is a system as in any of Examples 3-18, wherein the lid assembly is configured to seal the opening of a #10 canister.

Example 20 is a system for sealing a container. The system includes a lid assembly for selectively sealing an opening of a container. The lid assembly includes a recessed portion configured to facilitate coupling the lid assembly with an external vacuum source and a hole disposed within the recessed portion of the lid assembly. The lid assembly includes a ball seal disposed in the hole, the ball seal configured to seal the hole in a closed position when a vacuum pressure is created within the container. The lid assembly includes a gasket cavity disposed within the lid assembly, the gasket cavity configured to align a gasket for creating a seal between the lid assembly and the container. The system includes a coupler assembly for facilitating an evacuation process for removing air from the container. The coupler assembly includes a coupler body; a coupler seal disposed about an exterior of the coupler body; and a vacuum port configured to facilitate connection with a mechanical vacuum apparatus via a vacuum hose.

Example 21 is a system as in Example 20, wherein the lid assembly further comprises one or more reinforcement ribs extending radially from the recessed portion to an outer edge of the lid assembly.

Example 22 is a system as in any of Examples 20-21, wherein the ball seal permits airflow out of the container through the hole of the lid assembly during an evacuation process and the ball seal seals the hole in a closed position when a lower pressure is achieved inside the container relative to atmospheric or external pressure.

Example 23 is a system as in any of Examples 20-22, wherein the ball seal comprises: a spherical ball comprising a circumference greater than an inside boundary of the hole of the lid assembly; and a ball seal retaining member comprising a stem and a T-end. The ball seal is such that the ball seal retaining member extends through the hole of the lid assembly and the spherical ball is located on an exterior side of the lid assembly relative to the container. The ball seal is such that the T-end of the ball seal retaining member comprises an outside perimeter greater than the inside boundary of the hole such that the ball seal is retained within the hole of the lid assembly.

Example 24 is a system as in any of Examples 20-23, wherein the ball seal further comprises a stem, and wherein the stem comprises: a stem length sufficient for the ball seal to move in a vertical direction approximately normal to the lid apparatus when the ball seal is disposed within the hole; an upper portion located near the spherical ball of the ball seal; and a lower portion located near the T-end of the ball seal retaining member. The stem of the ball seal is such that the lower portion comprises a shorter diameter than the upper portion.

Example 25 is a system as in any of Examples 20-24, wherein: the ball seal provides a seal for maintaining a vacuum pressure within the container; the ball seal further provides a means for releasing the vacuum pressure within the container and reintroducing air into the container; and the hole of the lid assembly provides the only means for extracting or introducing air into the container when the lid assembly forms a seal with the container.

Example 26 is a system as in any of Examples 20-25, wherein: the coupler seal of the coupler assembly creates an airtight seal between the coupler assembly and the recessed portion of the lid assembly such that a vacuum pressure may be created and maintained within the container when the lid assembly forms a seal with the container; and the ball seal contacts an inner surface of the coupler body during the evacuation process in which a vacuum pressure is created within the container.

Reference throughout this specification to "an example" means that a particular feature, structure, or characteristic described in connection with the example is included in at least one embodiment of the present disclosure. Thus, appearances of the phrase "in an example" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on its presentation in a common group without indications to the contrary. In addition, various embodiments and examples of the present disclosure may be referred to herein along with alternatives for the various components thereof. It is understood that such embodiments, examples, and alternatives are not to be construed as de facto equivalents of one another but are to be considered as separate and autonomous representations of the present disclosure.

Although the foregoing has been described in some detail for purposes of clarity, it will be apparent that certain changes and modifications may be made without departing from the principles thereof. It should be noted that there are many alternative ways of implementing both the processes and apparatuses described herein. Accordingly, the present embodiments are to be considered illustrative and not restrictive.

Those having skill in the art will appreciate that many changes may be made to the details of the above-described embodiments without departing from the underlying principles of the disclosure. The scope of the present disclosure should, therefore, be determined only by the following claims.

What is claimed is:

1. A system comprising:

a lid assembly configured to seal an opening of a container, the lid assembly comprising:

a recessed portion configured to facilitate coupling the lid assembly with an external vacuum source;

a hole disposed at the bottom of the recessed portion of the lid assembly;

a ball seal disposed in the hole, the ball seal configured to seal the hole in a closed position when a vacuum pressure is created within the container; and a gasket cavity disposed within the lid assembly, the gasket cavity configured to align a gasket for creating a seal between the lid assembly and the container; and a coupler assembly comprising a vacuum port, the coupler assembly configured to be disposed within and at the bottom of the recessed portion of the lid assembly at a position surrounding the ball seal and a perimeter of the hole.

2. The system of claim 1, wherein the lid assembly further comprises one or more reinforcement ribs extending radially from the recessed portion to an outer edge of the lid assembly.

3. The system of claim 1, wherein the ball seal permits airflow out of the container through the hole of the lid assembly during an evacuation process and the ball seal seals the hole in a closed position when a lower pressure is achieved inside the container relative to atmospheric or external pressure.

4. The system of claim 1, wherein the ball seal comprises:

a spherical ball comprising a circumference greater than an inside boundary of the hole of the lid assembly; and a ball seal retaining member;

wherein the ball seal retaining member extends through the hole and the spherical ball is located on an exterior side of the lid assembly relative to the container.

5. The system of claim 4, wherein the ball seal retaining member comprises a T-end, and wherein the T-end comprises an outside perimeter greater than the interior boundary of the hole such that the ball seal is retained within the hole of the lid assembly.

6. The system of claim 5, wherein the ball seal further comprises a stem connecting the spherical ball to the T-end of the ball seal retaining member, and wherein the stem comprises a sufficient length to permit the spherical ball to be lifted during an evacuation process such that air may pass through the hole of the lid assembly.

7. The system of claim 1, wherein the ball seal provides a seal for maintaining a vacuum pressure within the container and wherein the ball seal further provides a means for releasing the vacuum pressure within the container and reintroducing air into the container.

8. The system of claim 1, wherein the hole of the lid assembly provides the only means for extracting or introducing air into the container when the lid assembly forms a seal with the container.

9. The system of claim 5, wherein the ball seal further comprises a stem, and wherein the stem comprises:

a stem length sufficient for the ball seal to move in a vertical direction approximately normal to the lid apparatus when the ball seal is disposed within the hole;

an upper portion located near the spherical ball of the ball seal; and a lower portion located near the T-end of the ball seal retaining member;

wherein the lower portion comprises a shorter diameter than the upper portion.

10. The system of claim 1, wherein the coupler assembly further comprises:

a coupler body; and a coupler seal disposed about an exterior of the coupler body;

wherein the coupler body comprises an outside perimeter smaller than an interior boundary of the recessed portion of the lid assembly.

11. The system of claim 10, wherein the coupler seal creates an airtight seal between the coupler assembly and the recessed portion of the lid assembly such that a vacuum pressure may be created within the container when the lid assembly forms a seal with the container.

12. The system of claim 10, wherein the ball seal contacts an inner surface of the coupler body during an evacuation process in which a vacuum pressure is created within the container.

13. The system of claim 12, wherein the coupler body is sized such that a distance extending from the inner surface of the coupler body to an exterior surface of the recessed portion of the lid assembly permits airflow through the hole of the lid assembly during the evacuation process.

14. The system of claim 12, wherein the coupler assembly further comprises one or more channels disposed within the inner surface of the coupler body, wherein the one or more channels are configured to permit airflow during the evacuation process.

15. The system of claim 1, wherein the vacuum port of the coupler assembly facilitates connection with a mechanical vacuum apparatus via a vacuum hose such that the vacuum hose may fit over or inside the vacuum port.

16. The system of claim 1, wherein the coupler assembly further comprises a coupler body and wherein the coupler body is transparent such that a user may see the ball seal when the coupler is disposed within the recessed portion of the lid assembly.

17. The system of claim 1, wherein the lid assembly is configured to seal the opening of a #10 canister.

18. A system comprising:

a lid assembly configured to seal an opening of a container, the lid assembly comprising:

a recessed portion configured to facilitate coupling the lid assembly with an external vacuum source;

a hole disposed within the recessed portion of the lid assembly;

a ball seal disposed in the hole, the ball seal configured to seal the hole in a closed position when a vacuum pressure is created within the container; and a gasket cavity disposed within the lid assembly, the gasket cavity configured to align a gasket for creating a seal between the lid assembly and the container; and a coupler assembly comprising:

a vacuum port, a coupler body comprising an outside perimeter smaller than an interior boundary of the recessed portion of the lid assembly, and a coupler seal disposed about an exterior of the coupler body, wherein the coupler assembly is configured to be disposed within the recessed portion of the lid assembly, and wherein the ball seal contacts an inner surface of the coupler body during an evacuation process in which a vacuum pressure is created within the container.

19. The system of claim 18, wherein the lid assembly further comprises one or more reinforcement ribs extending radially from the recessed portion to an outer edge of the lid assembly.

20. The system of claim 18, wherein the coupler seal of the coupler assembly creates an airtight seal between the coupler assembly and the recessed portion of the lid assembly such that a vacuum pressure may be created and maintained within the container when the lid assembly forms a seal with the container;

the ball seal permits airflow out of the container through the hole of the lid assembly during an evacuation process and the ball seal seals the hole in a closed position when a lower pressure is achieved inside the container relative to atmospheric or external pressure.

21. The system of claim 18, wherein the ball seal comprises:

a spherical ball comprising a circumference greater than an inside boundary of the hole of the lid assembly; and a ball seal retaining member comprising a stem and a T-end;

wherein the ball seal retaining member extends through the hole of the lid assembly and the spherical ball is located on an exterior side of the lid assembly relative to the container; and wherein the T-end of the ball seal retaining member comprises an outside perimeter greater than the inside boundary of the hole such that the ball seal is retained within the hole of the lid assembly.

22. The system of claim 21, wherein the stem of the ball seal retaining member comprises:

a stem length sufficient for the ball seal to move in a vertical direction approximately normal to the lid apparatus when the ball seal is disposed within the hole;

an upper portion located near the spherical ball of the ball seal; and a lower portion located near the T-end of the ball seal retaining member;

wherein the lower portion comprises a shorter diameter than the upper portion.

23. The system of claim 21, wherein:

the ball seal provides a seal for maintaining a vacuum pressure within the container;

the ball seal further provides a means for releasing the vacuum pressure within the container and reintroducing air into the container; and the hole of the lid assembly provides the only means for extracting or introducing air into the container when the lid assembly forms a seal with the container.

24. A system comprising:

a lid assembly configured to seal an opening of a container, the lid assembly comprising:

a recessed portion configured to facilitate coupling the lid assembly with an external vacuum source;

a hole disposed within the recessed portion of the lid assembly;

a ball seal disposed in the hole, the ball seal configured to seal the hole in a closed position when a vacuum pressure is created within the container the ball seal comprising:

a spherical ball comprising a circumference greater than an inside boundary of the hole of the lid assembly;

a ball seal retaining member comprising a T-end, and wherein the T-end comprises an outside perimeter greater than the interior boundary of the hole such that the ball seal is retained within the hole of the lid assembly; and a stem comprising:

a stem length sufficient for the ball seal to move in a vertical direction approximately normal to the lid apparatus when the ball seal is disposed within the hole;

an upper portion located near the spherical ball of the ball seal; and a lower portion located near the T-end of the ball seal retaining member and comprising a shorter diameter than the upper portion; and a gasket cavity disposed within the lid assembly, the gasket cavity configured to align a gasket for creating a seal between the lid assembly and the container; and a coupler assembly comprising a vacuum port, the coupler assembly configured to be disposed within the recessed portion of the lid assembly;

wherein the ball seal retaining member extends through the hole and the spherical ball is located on an exterior side of the lid assembly relative to the container.

* * * * *